US012522324B2

(12) United States Patent
Akers et al.

(10) Patent No.: US 12,522,324 B2
(45) Date of Patent: Jan. 13, 2026

(54) FOOT PAD FOR SUBMERGED MACHINERY

(71) Applicant: Stationkeep LLC, Portland, ME (US)

(72) Inventors: Richard H. Akers, Portland, ME (US); Melissa E. Landon, Portland, ME (US)

(73) Assignee: StationKeep LLC, Portland, ME (US)

( * ) Notice: Subject to any disclaimer, the term of this patent is extended or adjusted under 35 U.S.C. 154(b) by 132 days.

(21) Appl. No.: 18/558,971

(22) PCT Filed: May 6, 2022

(86) PCT No.: PCT/US2022/028204

§ 371 (c)(1),
(2) Date: Nov. 3, 2023

(87) PCT Pub. No.: WO2022/236143

PCT Pub. Date: Nov. 10, 2022

(65) Prior Publication Data

US 2024/0375752 A1 Nov. 14, 2024

Related U.S. Application Data

(60) Provisional application No. 63/225,638, filed on Jul. 26, 2021, provisional application No. 63/185,549, filed on May 7, 2021.

(51) Int. Cl.

| | |
|---|---|
| ***B63B 21/27*** | (2006.01) |
| ***E02B 17/00*** | (2006.01) |
| ***E02D 27/52*** | (2006.01) |

(52) U.S. Cl.
CPC ..... *B63B 21/27* (2013.01); *E02D 27/525* (2013.01); *E02B 2017/0078* (2013.01)

(58) Field of Classification Search
CPC ..... B63B 21/27; E02D 27/525; E02B 2017/0082; E02B 2017/0078
(Continued)

(56) References Cited

U.S. PATENT DOCUMENTS 4,109,477 A * 8/1978 Vogel ..... E02B 17/02 405/226
4,266,888 A 5/1981 Bayer et al.
(Continued)

FOREIGN PATENT DOCUMENTS

CN 111619736 9/2020

OTHER PUBLICATIONS

International Search Report and Written Opinion, Aug. 10, 2022, 9pp.

*Primary Examiner* — Frederick L Lagman
(74) *Attorney, Agent, or Firm* — Caseiro Burke LLC; Nicholas A. McCrillis; Chris A. Caseiro

(57) ABSTRACT

A foot pad removably attachable to a machine and that supports the machine for operation in a fluid. The foot pad includes a support frame, a skirt coupled to the support frame, a bellows coupled to the skirt, a plenum arranged to move within the skirt, a seal between the plenum and the skirt, and a flexible bellows that allows the foot pad to be secured to, or within, a substrate. The skirt includes an edge that can be embedded in a penetrable substrate. The plenum is configured to pump the fluid into or out of a volume formed by a space below the plenum, the interior of the skirt, and the substrate, thus compressing or decompressing the fluid in the space inside the skirt. The foot pad may also include a rolling, flexible diaphragm to seal the space between the plenum and the skirt, wherein the rolling diaphragm minimized the wear compared to other seal mechanisms. The flexible bellows may include a set of radial ridges that aid in sealing the footpad to the substrate.

12 Claims, 10 Drawing Sheets

(58) Field of Classification Search
USPC ..... 405/224.1, 226
See application file for complete search history.

(56) References Cited

U.S. PATENT DOCUMENTS

| | | | | | |
|---|---|---|---|---|---|
| 4,662,789 | A * | 5/1987 | Lundberg | E02B 17/027 | 277/552 |
| 4,669,915 | A | 6/1987 | Shatto, Jr. | | |
| 4,695,200 | A * | 9/1987 | Hall | E02D 23/16 | 405/203 |
| 4,808,037 | A * | 2/1989 | Wade | E02D 9/04 | 405/226 |
| 6,488,446 | B1 * | 12/2002 | Riemers | E02D 27/52 | 405/203 |
| 7,407,342 | B2 * | 8/2008 | Seidel | E02D 27/52 | 405/224.1 |
| 7,690,134 | B2 * | 4/2010 | Kim | E02F 3/88 | 405/226 |
| 7,891,910 | B2 * | 2/2011 | Schakenda | E02D 27/52 | 405/226 |
| 8,021,082 | B2 * | 9/2011 | Thomas | B63B 21/27 | 405/224.1 |
| 8,025,463 | B2 * | 9/2011 | Foo | B63B 21/27 | 405/226 |
| 8,668,408 | B2 * | 3/2014 | Foo | E02B 17/021 | 405/226 |
| 2003/0145835 | A1 | 8/2003 | Djordjevic | | |

* cited by examiner

FOOT PAD FOR SUBMERGED MACHINERY

BACKGROUND OF THE INVENTION

1. Field of the Invention

The present invention relates to devices that can be used to secure equipment to an underlying surface or substrate. More particularly, the present invention relates to such devices that can be used to secure and remove equipment on submerged surfaces or substrates.

2. Description of the Prior Art

Securing equipment or a machine in a submerged environment can be difficult. This type of foundation or anchor, called foot pad, is applicable to securing equipment or a machine on a submerged rigid surface that includes, but is not limited to, a pipe or tank wall. This device is also applicable to securing equipment or a machine on a soft, wet surface that includes, but is not limited to, the seafloor, a riverbed, a shallow-water mudflat or bog, or a permafrost surface. Surfaces such as these and others, collectively called penetrable substrates or impenetrable surfaces, provide little support force per unit area, and without the required support, equipment can sink into the substrate or slide off the surface. Furthermore, if a foundation with a large area is used, a penetrable substrate can seal the edges of the foundation so that retrieving the foundation becomes difficult due to suction forces that develop in the substrate resisting the retrieval. If a large area foundation is employed for equipment in fast moving water, the foundation may offer low shear forces resisting sideways movement of the equipment and the foundation and equipment may slide sideways, possibly losing contact with the substrate.

A foot pad foundation is needed that will provide an adhesion force holding the equipment to the substrate, a shear force keeping the foot pad and associated equipment from sliding or rotating and disengaging with the substrate, and a mechanism to detach the foot pad from the substrate quickly and efficiently.

SUMMARY OF THE INVENTION

The foot pad described herein is a foundation device that is attached to a machine and supports the machine while submerged in a fluid on either an impenetrable surface or a penetrable substrate. The foot pad is a type of anchor or foundation that can attach to an impenetrable surface or penetrate a penetrable substrate to a desired depth. The foot pad engages with the surface and allows the machine to remain stationary to operate as designed.

The foot pad is an anchor or foundation meant to be installed on an impenetrable surface or to penetrate a penetrable substrate when the foot pad is submerged within a fluid (e.g., in a tank or water body). The foot pad is installed, attached, and/or removed using a combination of net underpressure and/or overpressure within one or more of the foot pad's internal volume chambers bounded by the external components of the device. When compared to the ambient fluid pressure outside the device, underpressure is defined as a pressure less than the ambient fluid pressure and overpressure is defined as a pressure greater than the ambient fluid pressure. The net fluid pressure difference within the foot pad compared to ambient pressure allows the foot pad to conform with, secure to, and/or release from, the submerged impenetrable or penetrable substrate. The net underpressure and/or underpressure internal to the foot pad is used to temporarily attach and detach the foot pad from the substrate, providing a foundation or footing for a stationary or ambulator machine.

DETAILED DESCRIPTION OF THE INVENTION

Figure 1:
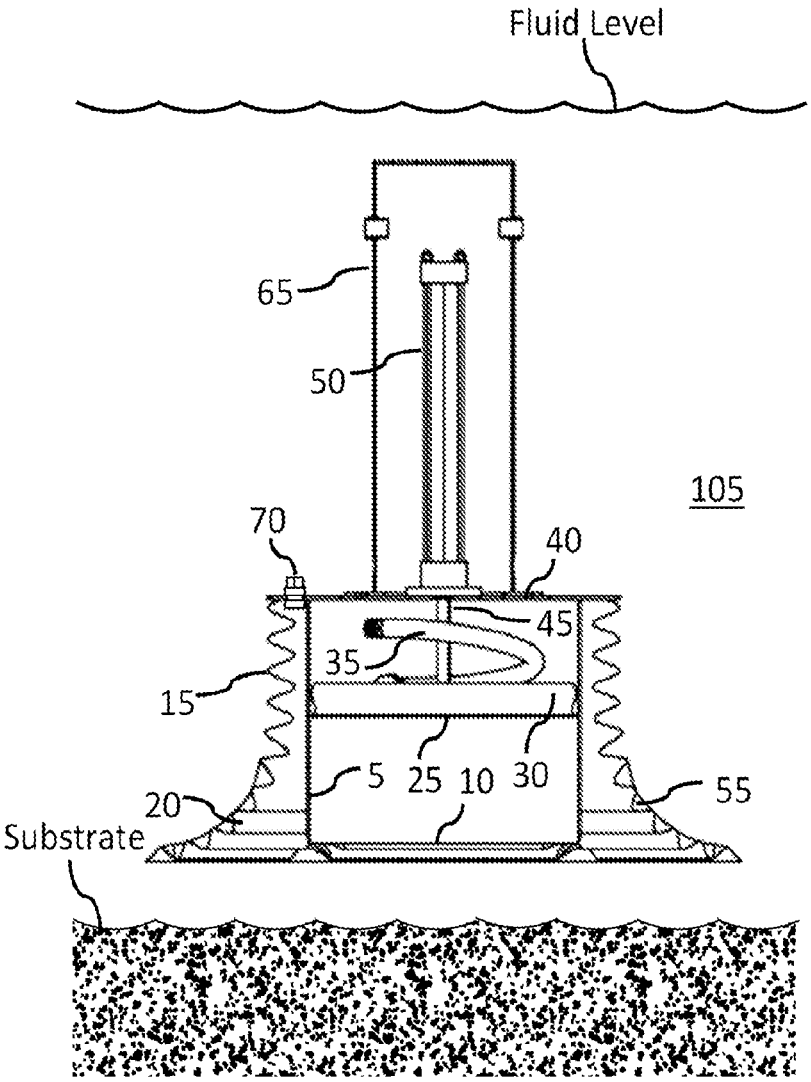
FIG. 1—Foot pad, elevation, section view—default extension.

A foot pad [105] of the present invention is illustrated in the drawings, shown in FIGS. 1-6. The foot pad [105] includes a support frame [40]; a Skirt [5] with an edge [10] that can be embedded in a substrate; a bellows [15] with low material stiffness that captures an under- or over-pressure between the bellows and the substrate; an optional flared section [20] at the bottom of the bellows [15] with an average cross-sectional area larger than that of the bellows [15]; a piston [25] that can move inside the skirt [5] so as to pump fluid under the piston [25] into a volume formed by a space between the piston [25], the inside wall of the skirt [5], and the substrate; and a flexible diaphragm [30] that seals the piston [25] to the skirt [5], a hose [35] that can facilitate fluid movement or pressurization between inside of the bellows [15], flared section [20], skirt [5], and substrate; an auxiliary fluid port [70] that allows an external pump to be connected to the space between the bellows [15] and the skirt [5].

Figure 2:
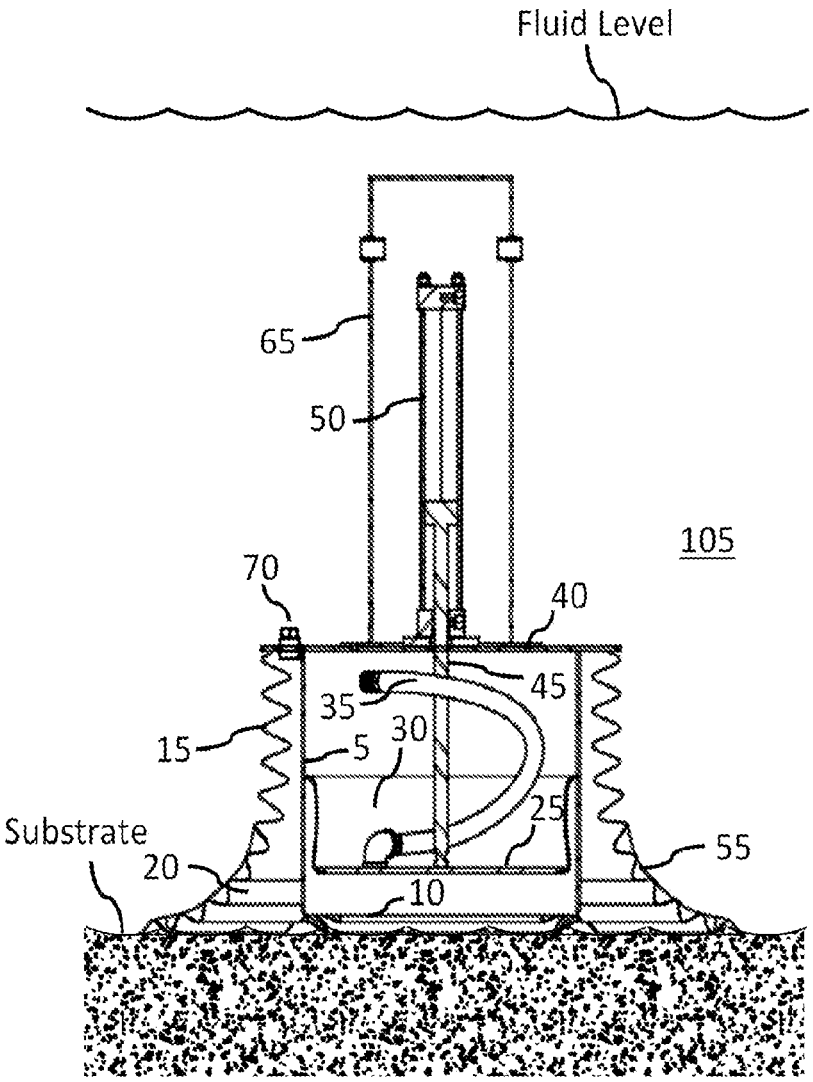
FIG. 2—Foot pad, elevation, section view—piston, Bellows fully extended, making first contact with surface of impenetrable surface or penetrable substrate.
Figure 3:
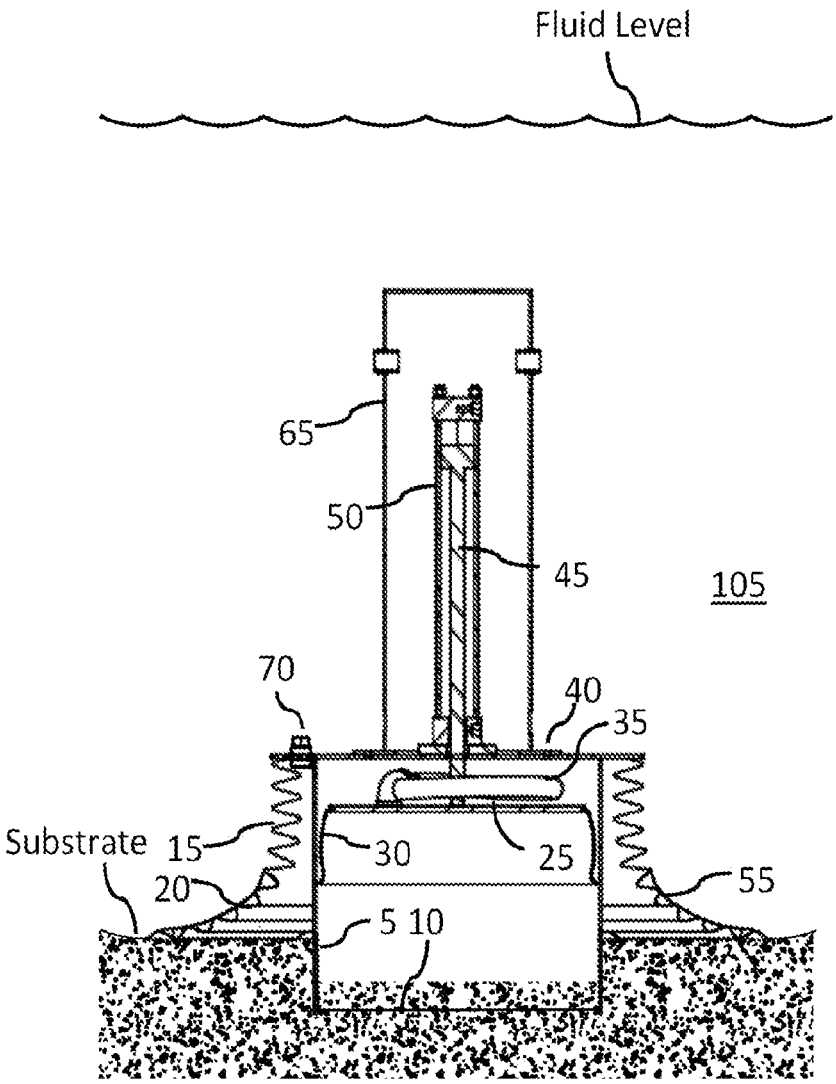
FIG. 3—Foot pad, elevation, section view—piston retracted to upper position, Bellows compressed, skirt embedded in penetrable substrate.
Figure 4:
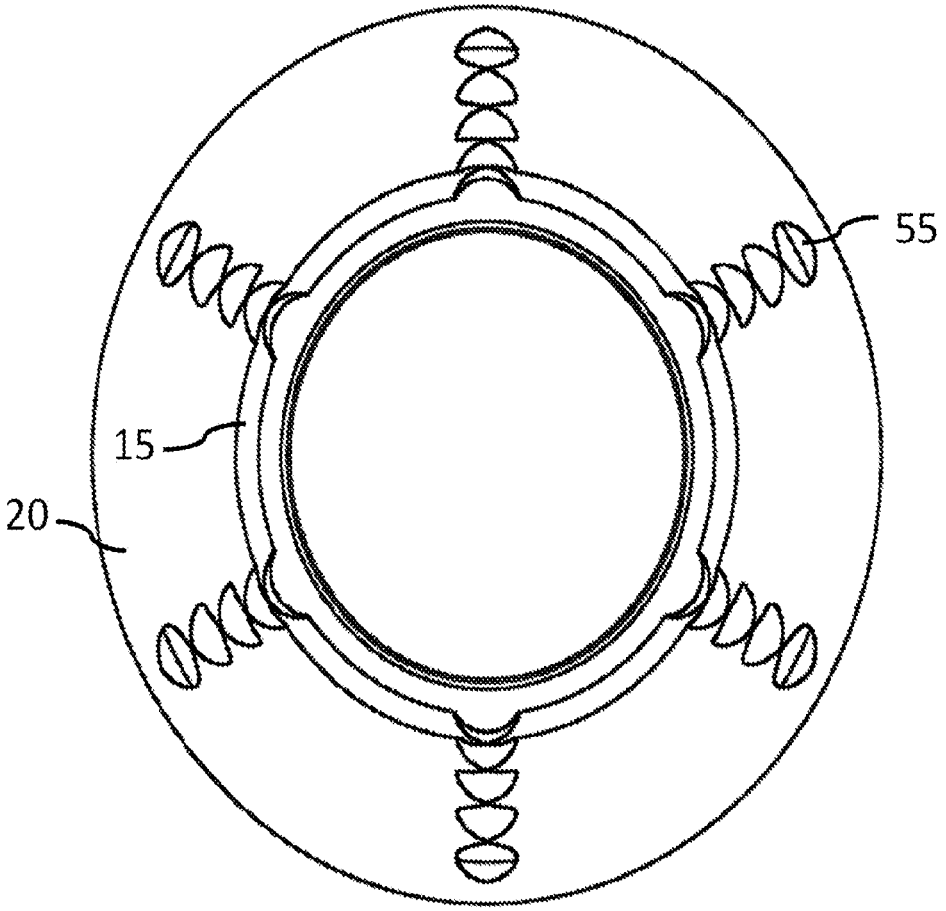
FIG. 4—Foot pad bellows, bottom view.
Figure 5:
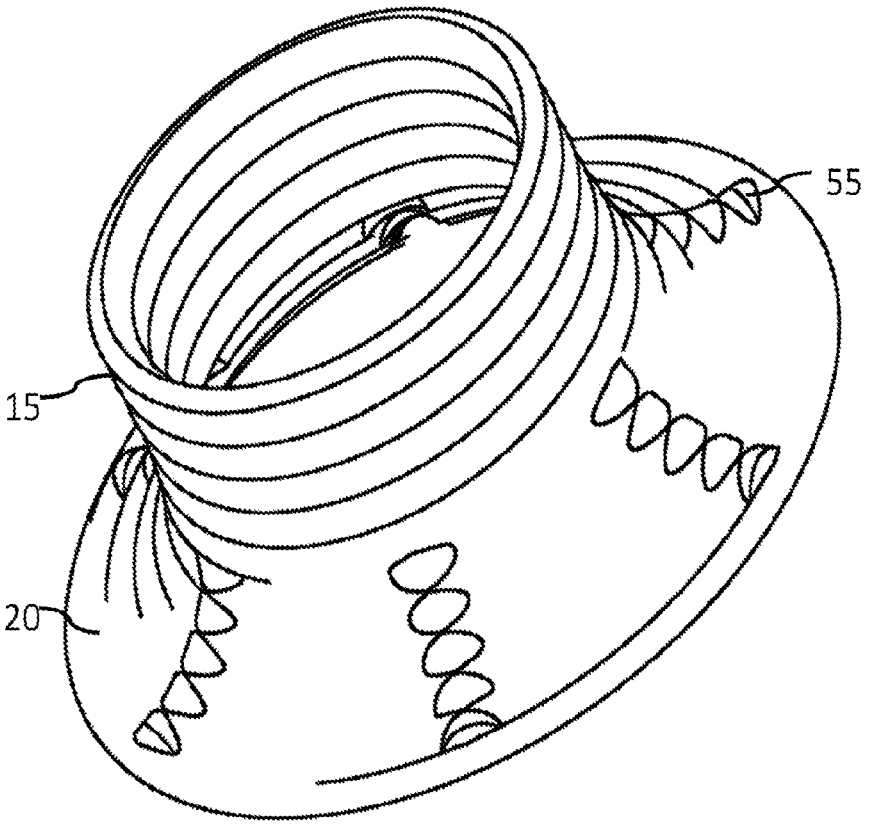
FIG. 5—Foot pad bellows, isometric view.
Figure 6:
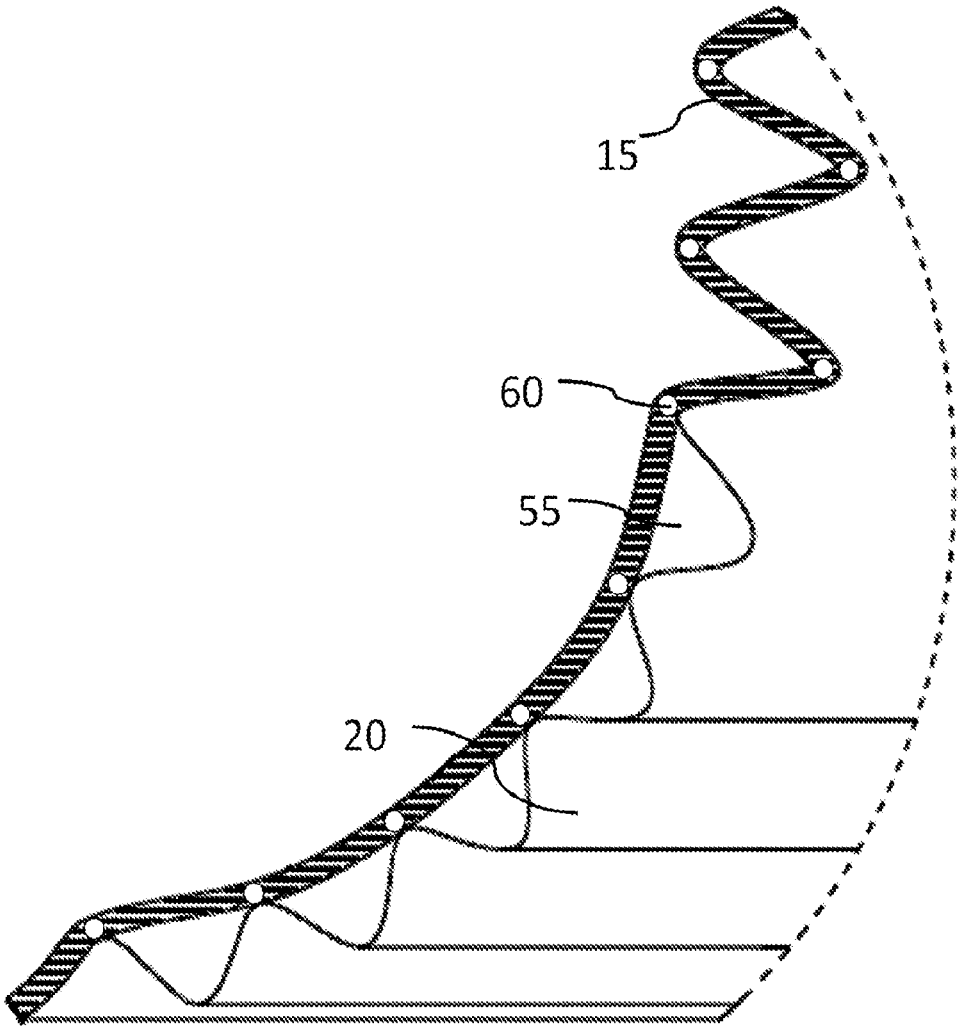
FIG. 6—Foot pad bellows, cross-section, showing stiffening wires in bellows material.

FIG. 1 illustrates the foot pad [105] in cross-section in elevation before it interacts with the impenetrable surface or penetrable substrate. FIG. 2 illustrates the foot pad [105] in cross-section in elevation once the bellows [15] or flared section [20] interacts with the impenetrable surface or penetrable substrate. For an impenetrable surface, the bellows [15] and flared section [20] can be used to create a seal and the skirt [5] provides lateral support for the foot pad [105]. FIG. 3 illustrates the foot pad [105] installed on a penetrable substrate, where the skirt [5] penetrates the substrate to provide additional lateral support of the foot pad [105].

The piston [25] is secured to one or more shafts [45] that are driven up or down relative to the skirt [5] and bellows [15] by a drive mechanism [50] external to the foot pad [105]. The drive mechanism [50] may be a hydraulic cylinder, electric cylinder, motor-driven lead screw or other mechanism capable of creating vertical force. The skirt [5] is rigid and can be made of metal, stiff plastic, or composite materials. The skirt [5] is of a multi-sided or cylindrical shape, open at the bottom or substrate-facing side. The skirt may have a beveled or formed edge [10] at the substrate-facing edge to facilitate skirt [5] embedment in a penetrable substrate. The top of the skirt [5] and the bellows [15] are attached to the support frame [40], which transfers vertical and horizontal loads to a connector structure [65]. The skirt [5] may vary in length to develop uplift resistance through friction between the impenetrable substrate and the skirt [5] material, which uplift resistance enables the foot pad [105] to retain equipment of interest to the surface or substrate. The foot pad [105] is configured to permit change-out of a different length skirt [5]. That is, the length of the skirt [5] is selectable.

The bellows [15] and flared section [20] are made of a fiber-reinforced, natural, or synthetic rubber. The fiber-reinforcement in the bellows [15] and flared section [20] may be natural or synthetic; may be parallel, perpendicular, or diagonal at a variety of other angles with the plane of the piston [25]; and may be individually laid, woven, or knitted. The bellows [15] may have stiffeners [60] or stiff hoops at each bend. The stiffeners [60] may be made from steel or composite wire or rods. The bellows [15] contacts and presses on the substrate to maintain an adequate seal with the substrate without embedment (impenetrable surface) or with minimal embedment (penetrable substrate) of the bellows [15]. The optional, larger average diameter and larger cross-sectional area flared section [20] of the bellows [15] would enlarge the footprint of the bellows [15] at the substrate surface.

In the flared section [20], the bellows [15] has circular concentric ridges that increase the ability of the flare to form a seal with the impenetrable surface or penetrable substrate and may have radial channels [55] that allow the pressure differential to be distributed between the outer ridges at the ends of the flared section [20].

Fluid can flow, and a pressure differential can be established between the volume inside the skirt [5] and the volume outside the skirt [5] inside the bellows [15]. This fluid flow may be accomplished by using a hose [35].

Figure 7:
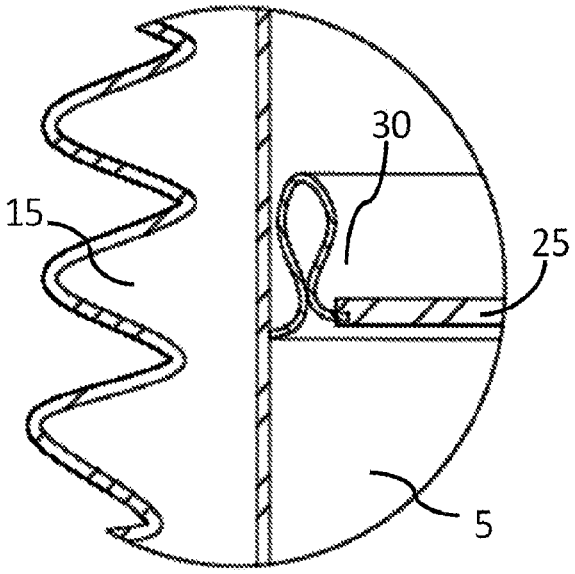
FIG. 7—Flexible diaphragm seal between moving piston and skirt, cut away elevation view.

The piston [25] is inside the skirt [5], with a small gap between the piston [25] and the skirt [5] to eliminate friction. In one embodiment, as shown in FIG. 7, a rolling diaphragm [30] fills the gap between the piston [25] and the skirt [5] and creates a pressure barrier between the volume above and below the piston [25]. When the piston [25] is moved toward the open end of the skirt [5], the fluid under the piston [25] is pressurized, creating a downward force on the impenetrable surface or penetrable substrate and a corresponding upward force on the piston [25]. When the piston [25] is moved away from the open end of the skirt [5], the fluid is depressurized, creating an upward force on the surface or substrate and a corresponding downward force on the piston [25].

Figure 8:
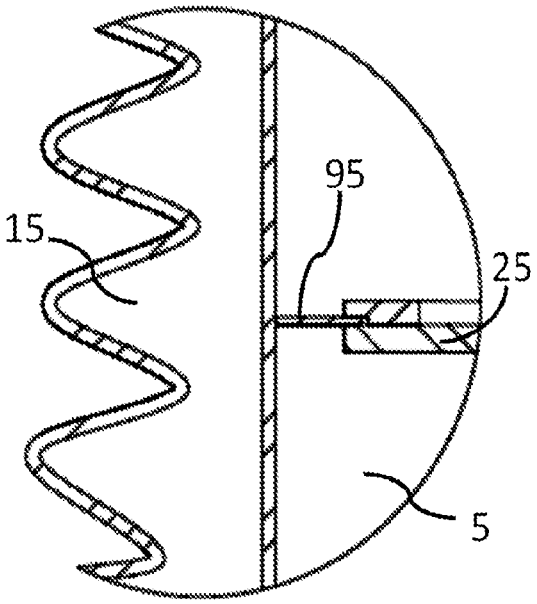
FIG. 8—Friction seal between moving piston and skirt, cut away elevation view.

An alternative embodiment to a flexible diaphragm [30] is a metal, natural rubber, or synthetic rubber friction seal [95] to fill the gap between the piston [25] and the skirt [5], as shown in FIG. 8, which acts as a pressure barrier between the space inside the skirt [5] and the unpressurized water above the piston [25].

The foot pad [105] can withstand vertical compression/extension, horizontal shear, overturning moment, and rotational torsion loading from an external source such as from the fluid or from the associated connector structure [65].

The foot pad [105] is used to support a machine. Multiple foot pads [105] can be configured onto the machine to provide the necessary stability and functionality of the machine. The foot pad [105] can supply vertical, horizontal, and rotational reaction forces when engaged with an impenetrable surface or penetrable substrate.

The foot pad [105] structural components and the skirt [5] may be made of steel or an aluminum alloy for strength. The bellows [15] and flared section [20] may be made of natural rubber or a mix of synthetic and natural rubber, reinforced by stiffeners [60] so the bellows [15] and flared section [20] retain shape when compressed. The stiffeners [60] may be made of metal or composite wire or rods.

The skirt [5] length is chosen to match environmental conditions. Where the foot pad [105] interacts with an impenetrable surface, a short skirt [5] is used. The skirt [5] provides lateral support to the bellows [15] and flared section [20]. When the piston [25] is retracted inside the skirt [5], an underpressure is developed inside the bellows [15] or flared section [20], and the skirt [5] that allows the bellows [15] or flared section [20] to compress and form a seal with the impenetrable surface. This attaches the foot pad [105] to the impenetrable surface until the underpressure is released. Since the skirt [5] cannot penetrate the surface the bellows [15] or flared section [20] is in contact with, the length of the skirt [5] must be selected to be long enough for support but short enough so as not to interfere with compression of the bellows [15] and flared section [20] given the ambient fluid pressure and required underpressure.

Where the foot pad [105] interacts with a penetrable substrate, a longer skirt [5] is used. The skirt [5] will penetrate the substrate and provide lateral support to the bellows [15] and flared section [20] and anchoring support and resistance to shear, moment, and torsional loads imposed on the foot pad [105] from the environment and/or system that is being anchored by the foot pad [105]. When the piston [25] is retracted inside the skirt [5], an underpressure is developed inside the bellows [15], flared section [20], and skirt [5], which drives the skirt [5] to penetrate the substrate and causes the bellows [15] or flared section [20] to compress. Fluid seepage through the penetrable substrate and through the imperfect seal between the substrate and the bellows [15] or flared section [20] will serve to decrease the underpressure. Thus, motion of the piston [25] must be fast enough to create an underpressure that is sufficient to embed the skirt [5] into the substate, but low enough to avoid creating channels in the substrate that negate the underpressure. The motion of the piston [25] and resulting underpressure can be adjusted for the substrate type.

Figure 9:
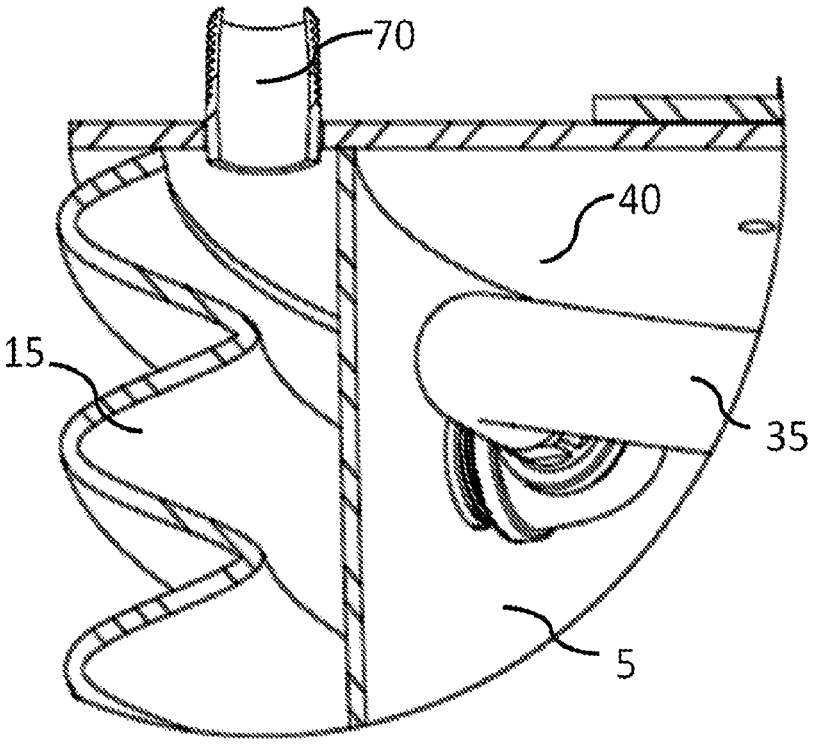
FIG. 9—Equalizer hose connects space inside skirt with space inside bellows and a single external port allows external control of pressure inside bellows, cut away elevation view.

Seepage can occur between the impermeable surface and the bellows [15] or flared section [20] because of an irregular shape or seal. Seepage can also occur between the penetrable substrate and the bellows [15] or flared section [20] based on the level of permeability and porosity of the penetrable substrate to the surrounding fluid under non-ambient pressures (e.g., underpressure or overpressure). If a large enough seepage velocity or force is established in the penetrable substrate because of piston [25] movement to create underpressure, the underpressure may be released. In that case, an auxiliary water pump may be connected to the auxiliary fluid port [70] to maintain the underpressure for the duration of the equipment use, as shown in FIG. 9. The pressure inside the skirt [5] will be equalized with the pressure inside the bellows [15] by the hose [35].

Figure 10:
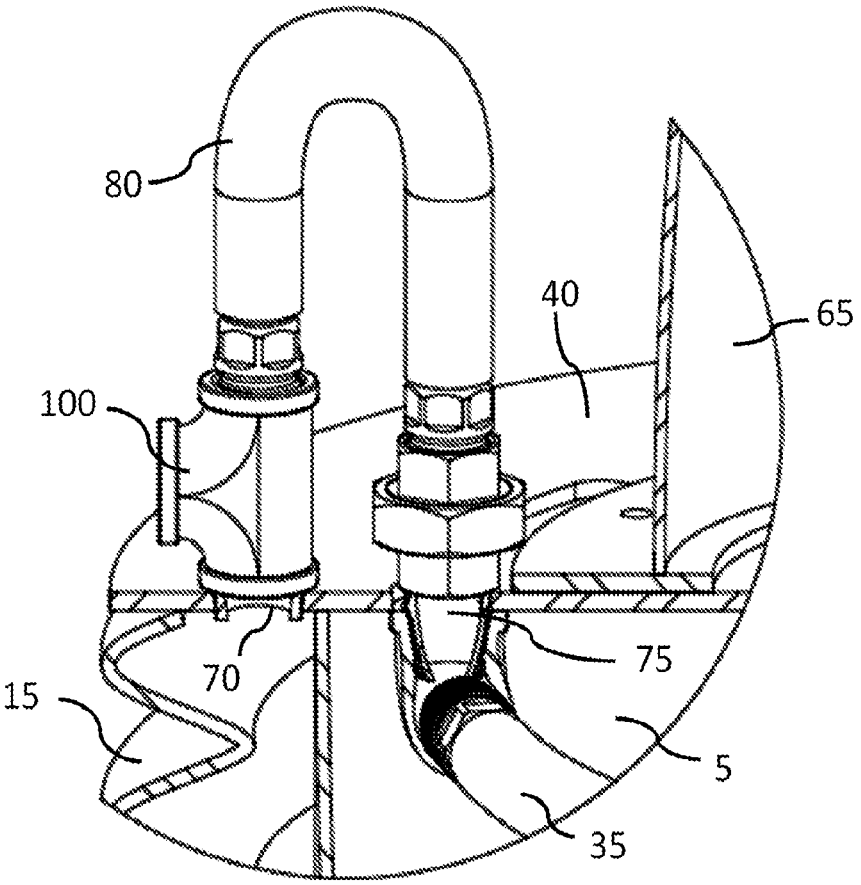
FIG. 10—One external port connects outside fluid to space inside bellows, second external port connects outside fluid to equalizer hose which goes to port on piston, connecting space inside skirt to outside fluid. Jumper hose connects the two external ports, cut away elevation view.

FIG. 10 shows an alternative configuration in which the hose [35] attached to a port in the piston [25] connects the space inside the skirt [5] to an external port [75]. An external jumper hose [80] is used to equalize the pressure inside the skirt [5] and the pressure inside the bellows [15]. The jumper hose [80] could include an optional tee [100] to a secondary pump port [90] to allow an external pressure source to control the pressure inside the skirt [5] and the bellows [15], although that tee [100] is not a required feature.

Figure 11:
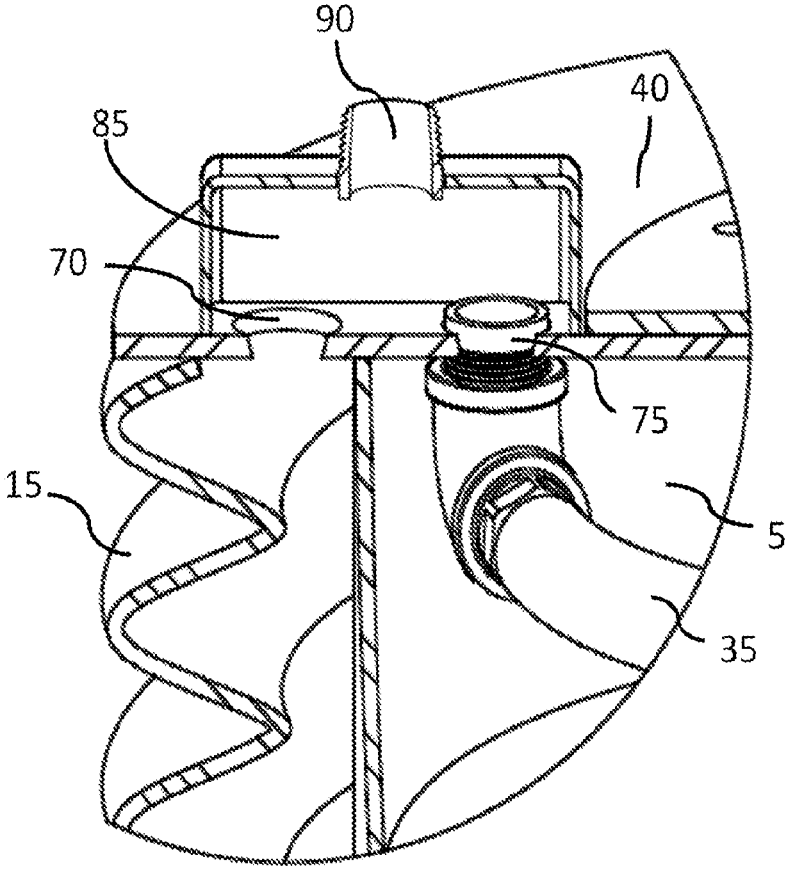
FIG. 11—One external port connects space inside pressure channel to space inside bellows, second external port connects space inside pressure channel to equalizer hose which goes to port on piston, connecting space inside skirt to fluid in channel and on to space inside bellows. Channel fabricated on support structure connects the two external ports and provides for external port, cut away elevation view.

FIG. 11 shows an alternative configuration in which the hose [35] connects to the external port [75]. A fixed pressure channel [85] is fabricated as part of the rigid frame [40] and connects the auxiliary fluid port [70] and the external port [75], while also adding an optional secondary pump port [90] to allow an external pressure source to control the pressure inside the skirt [5] and the bellows [15], although the secondary pump port [90] is not a required feature.

Sideways or lateral movement will be resisted by the bellows [15] and/or flared section [20] and the skirt [5]. When the bellows [15] or flared section [20] is compressed against either the impenetrable surface or penetrable substrate, it can oppose sideways movement by creating a shear force through friction. When the skirt [5] is embedded in the penetrable substate, the skirt [5] cross-sectional area will provide additional shear resistance by laterally loading of the substrate.

The foot pad [105] can be used with an ambulatory machine. A plurality of the foot pads [105] would be released from the impenetrable surface or penetrable substrate, moved, and reattached at a different location, resulting in a walking motion. This action requires relatively quick attachment and retraction, which can be accomplished through timing and control of the piston [25] in each foot pad [105] of a multi-pad system.

What is claimed is:

1. A foot pad removably attachable to a machine and that supports the machine while submerged in a fluid, the foot pad comprising:
   - a support frame;
   - a rigid skirt coupled to the support frame, wherein the rigid skirt includes an edge that can be embedded in a substrate;
   - a bellows coupled to the rigid skirt;
   - a piston arranged to move within the rigid skirt, wherein the piston is configured to pressurize or depressurize a volume formed by a space between the piston, an interior of the rigid skirt, and the substrate and a space between the rigid skirt and the bellows; and
   - a flexible diaphragm arranged to seal the piston to the rigid skirt.

2. The foot pad of claim 1 wherein the bellows includes a flared section at a bottom portion of the bellows.

3. The foot pad of claim 1 further comprising a hose or flexible tube arranged to facilitate fluid movement or pressurization between an inside of the bellows, the skirt, and the substrate.

4. The foot pad of claim 1 further comprising an auxiliary fluid port of the support frame arranged to connect an external pump to a space between the bellows and the skirt.

5. The foot pad of claim 1 wherein the piston is secured to one or more shafts that are driven up or down relative to the skirt and the bellows by a drive mechanism located attached to the foot pad, wherein the drive mechanism is capable of applying a force to the piston so as to alter pressure in the skirt.

6. The foot pad of claim 5 wherein the drive mechanism is selected from the group consisting of a hydraulic cylinder, an electric cylinder, and a motor-driven lead screw.

7. The foot pad of claim 1 wherein the bellows includes one or more concentric bends.

8. The foot pad of claim 7 wherein each of the one or more concentric bends includes one or more stiffeners.

9. The foot pad of claim 7 wherein the bellows includes one or more radial channels extending from an inner surface of the bellows towards an outer edge of the bellows, and wherein the one or more radial channels cross one or more of the one or more concentric bends.

10. The foot pad of claim 1 wherein the substrate is an impenetrable surface, a length of the skirt is selected to provide lateral support to the bellows and when the piston is retracted inside the skirt, an underpressure is developed inside the bellows, allowing the bellows to compress, pushing the rigid skirt contained in the bellows against any porous surface on the substrate and forming a seal with the impenetrable surface.

11. The foot pad of claim 1 wherein the substrate is a penetrable substrate, a length of the skirt is selected to penetrate the substrate and provide lateral support to the bellows to anchor support and resistance to shear, moment, and torsional loads imposed on the foot pad and when the piston is retracted inside the rigid skirt and the bellows, an underpressure is developed inside the bellows and the skirt, which drives the skirt to penetrate the substrate and causes the bellows to compress against the substrate.

12. The foot pad of claim 11 wherein seepage of the fluid resulting from an imperfect seal between the penetrable substrate and the bellows that decreases the underpressure is minimized by an auxiliary fluid port of the support frame arranged to connect an external pump to a space between the bellows and the skirt.

* * * * *